United States Patent [19]

Fernandez

[11] Patent Number: 4,818,974

[45] Date of Patent: Apr. 4, 1989

[54] ROBBERY IN PROCESS WARNING SYSTEM

[76] Inventor: James I. Fernandez, P.O. Box 741, Hilo, Hi. 96721

[21] Appl. No.: 13,244

[22] Filed: Feb. 10, 1987

[51] Int. Cl.[4] ..... G08B 13/00

[52] U.S. Cl. ..... 340/574; 109/21; 109/40; 340/570; 340/691

[58] Field of Search ..... 340/574, 540, 691, 570, 340/571; 109/38, 21, 31, 32, 39, 40

[56] References Cited

U.S. PATENT DOCUMENTS

| | | | |
|---|---|---|---|
| 1,700,950 | 9/1925 | Pijakowski . | |
| 1,924,783 | 6/1930 | Goss . | |
| 3,300,770 | 1/1967 | Etal | 340/570 |
| 3,467,771 | 3/1968 | Polack . | |
| 3,537,409 | 11/1970 | Farley, Jr. | 109/21 |
| 4,212,003 | 7/1980 | Mishoe et al. | 340/691 |
| 4,268,823 | 5/1981 | Rauchut et al. | 340/570 |

*Primary Examiner*—Joseph A. Orsino
*Assistant Examiner*—Anh H. Tran
*Attorney, Agent, or Firm*—Fleit, Jacobson, Cohn & Price

[57] ABSTRACT

An electrically actuated warning system is provided for a banking institution including a plurality of teller stations and a plurality of remote bank employee stations at each of which a desk top-type work surface is provided including a name plate assembly having a front face bearing the corresponding bank employee's name facing toward the teller stations and a rearface having a plurality of silent electrically actuated visual warning signals thereon facing away from the teller stations. Each teller station includes a manually actuable switch and the warning signals at each bank employee's station include a warning signal for each of the teller stations. Actuation of each teller switch is operative to actuate the warning signal at each bank employee station.

11 Claims, 2 Drawing Sheets

ROBBERY IN PROCESS WARNING SYSTEM

BACKGROUND OF THE INVENTION

1. Field of the Invention

This invention relates to a warning system by which manned security zones, such as bank teller stations, each may render a visual warning of a robbery in process to remote manned signal receiving locations, such as a bank information clerk location and a bank officer location. The signals rendered are of the silent, readily visual type and are arranged relative to the security zones such that persons at the security zones may not visually perceive the signals rendered to the signal receiving locations.

2. Description of Related Art

Various different forms of alarm systems incorporating some of the general structural and operational features of the instant invention are disclosed in prior U.S. Pat. Nos. 1,700,950, 1,924,783, 3,467,771 and 4,268,823. However, these previously known forms of warning systems have not incorporated structural and operational features which tend to avoid detection by bank robbers either prior to or subsequent to actuation of the warning systems. Therefore, in view of the need for a more effective warning system and further in view of the need for a warning system which will afford maximum safety for bank personnel, an improved and more effective system incorporating features tending to provide more safety for bank employees is provided.

SUMMARY OF THE INVENTION

This invention relates to an electrically actuatable warning system primarily for banking institutions such as banks including internal building areas incorporating security zones such as bank teller areas and remote signals receiving locations such as information clerk and bank officer locations. The warning system includes a signal actuator at each teller's location and a signal generator for each remote information clerk and/or bank official location. The signal generators comprise low intensity electrically actuatable light sources and the light sources are mounted upon the back faces of desk supported name plates, the front name-bearing faces of the name plates facing generally toward the security zones, whereby the rear faces thereof may not be viewed from the security zones.

Desk top name plates are utilized to support the light sources of the warning system in a manner which is not obvious from the security zones thereby enabling the light sources to be readily viewed by persons manning an information desk or a bank official's desk without knowledge of the warning signal provided by any person at any of the security zones. By utilizing name plates, the banking institution interior area has the appearance of a conventional banking institution building area and a person about to commit a robbery is unable to view anything unusual which might lead that person to believe the warning system is present and operational.

The light sources at each information or bank official location corresponding to a specific security zone such as a bank teller zone may be actuated by the person manning that bank teller zone. The method utilized at the bank teller zone for actuating the warning system may vary. For example, each bank teller location may be supplied with an undercounter or floor mounted pushbutton, or a designated cash drawer compartment may have a pressure or light sensitive switch disposed therein.

The main object of this invention is to provide a robbery in process warning system which may be used in different banking institutions as well as in other environments incorporating one or more security zones.

Another object of this invention, in accordance with the preceding object, is to provide a warning system for banks which will not give any outward appearance to a bank robber that may suggest the presence of the warning system.

A further object of this invention is to provide a warning system in accordance with the preceding objects and which will be capable of rendering a silent but readily viewable visual signal to a person manning an information desk or a bank officer's desk.

Yet another important object of this invention is to provide a robbery in process warning system which may be actuated in an unobtrusive manner.

A final object of this invention to be specifically enumerated herein is to provide a robbery in process warning system in accordance with the preceding objects and which will conform to conventional forms of manufacture, be of simple construction and easy to use so as to provide a device that will be economical feasible, long-lasting and relatively trouble free in operation.

These, together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a front prospective view of a desk name plate for use in each of the signal receiving locations illustrated in FIG. 1;

FIG. 4 is a rear prospective view of the desk name plate of FIG. 3 illustrating a signal generator for each of the security locations illustrated in FIG. 1.

DESCRIPTION OF THE PREFERRED EMBODIMENT

Figure 1:
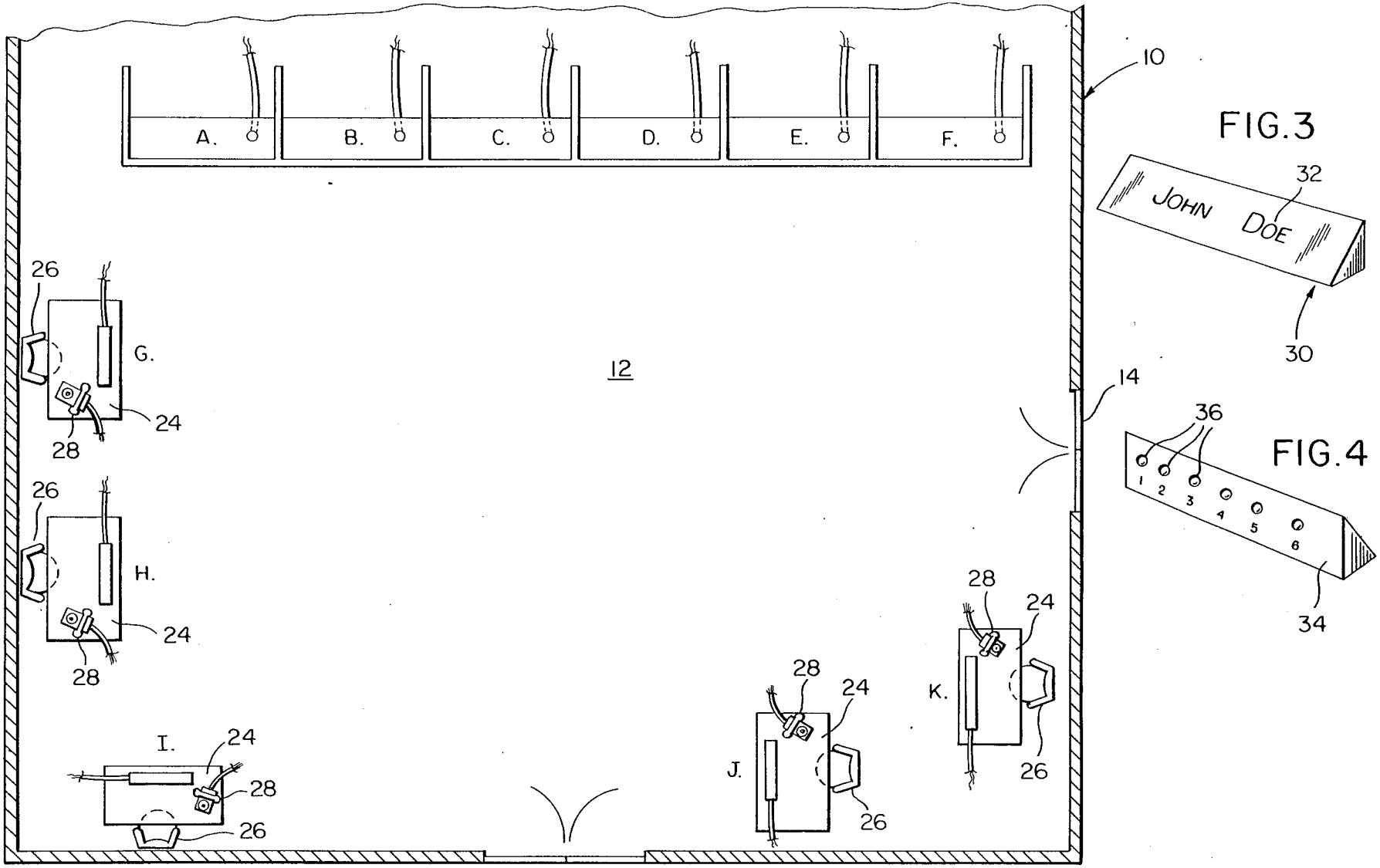
FIG. 1 is a fragmentary schematic horizontal sectional view illustrating an enclosed building area including a plurality of manned security zones and a plurality of signal receiving locations.
Figure 2:
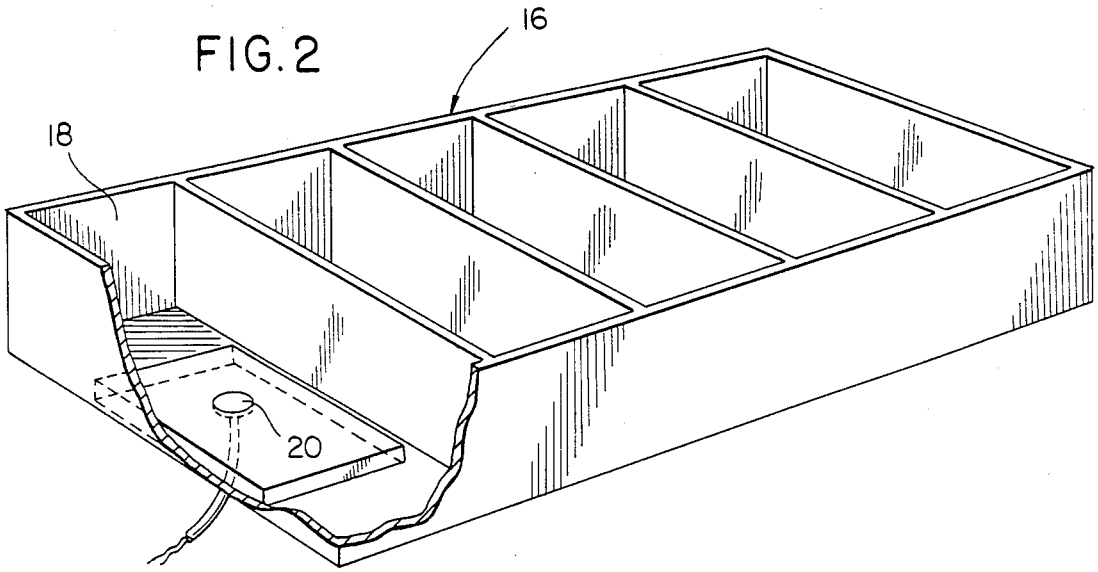
FIG. 2 is a fragmentary prospective view of a cash drawer incorporating a signal actuating switch, which drawer may be used in each of the security locations illustrated in the upper portion of FIG. 1.

Referring now more specifically to the drawings the numeral 10 generally designates a building having an interior area 12 which may comprise the offices of a banking institution. An entrance and exit door 14 is provided for the area 12 of the building 10 and the area 12 includes six security zones A, B, C, D, E and F, which zones may comprise bank teller locations with each location being provided with a cash drawer referred to in general by the reference numeral 16 and including at least one compartment 18 therein in which a switch 20 is disposed. The switch 20 may be a pressure sensitive switch whereby the switch 20 is closed upon the removal of gravity weighted material from thereover, or the switch 20 may be of the light sensitive type whereby it is closed as a light blocking object is removed from thereover to allow ambient light to fall incident thereon. Of course, each of the teller locations A–F may be manned by a bank teller and thus is considered as a manned security zone.

In addition, the area 12 includes manned signal receiving locations G, H, I, J and K. These locations each may include a desk 24 and an accompanying chair 26 therebehind. Also, each desk 24 may be equipped with a telephone 28.

In addition to the telephone 28, the upper surface of each desk 24 may support a name plate assembly referred to in general by the reference numeral 30 and including indicia 32 on its front face comprising the name of the person usually seated in the corresponding chair 26. On the other hand, the name plate assemblies 30 each include a rear face 34 from which electrically actuatable signal lights 36 are supported, each name plate assembly 30 including a signal light 36 corresponding to each of the security zones A–F.

Figure 5:
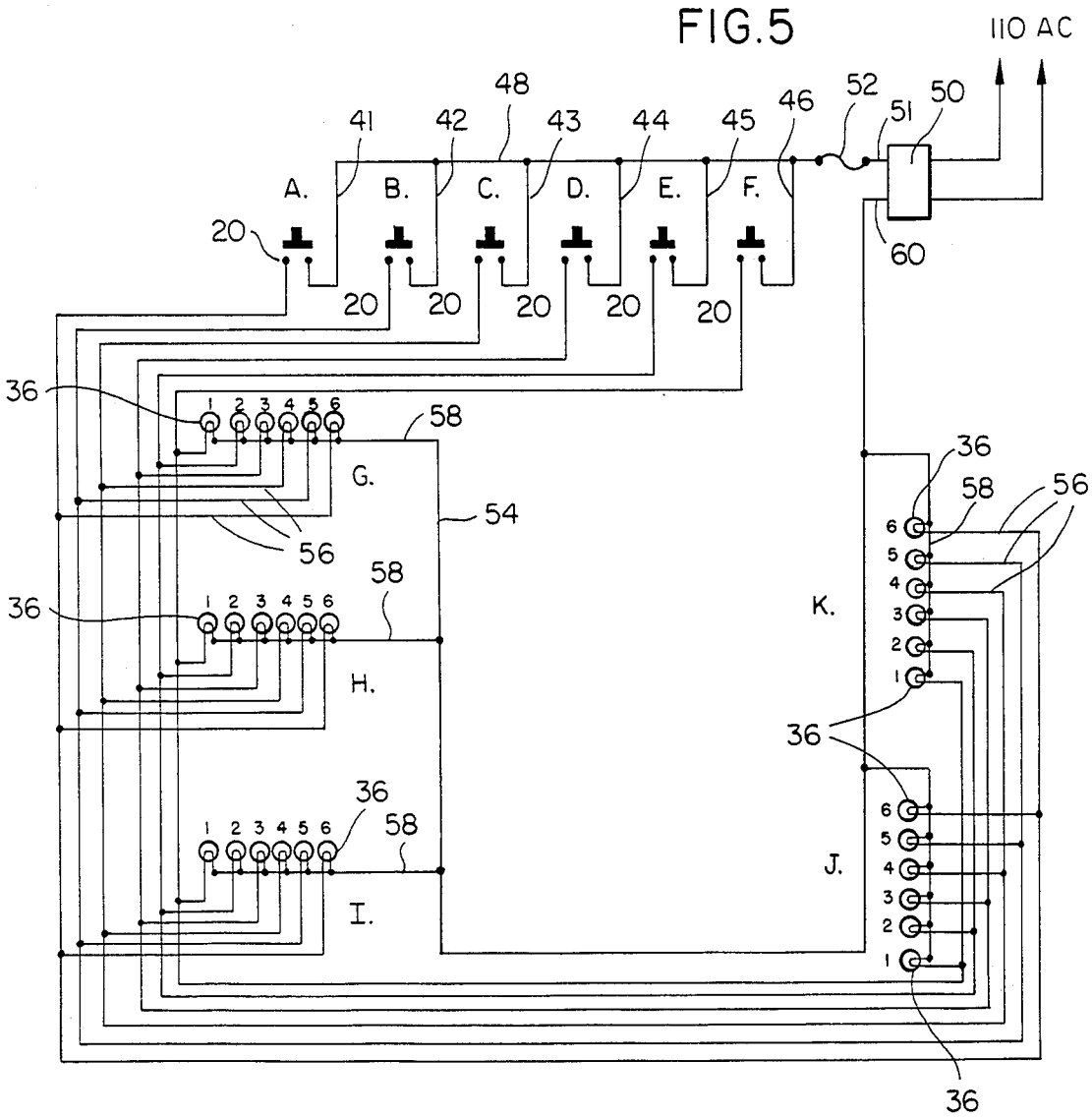
FIG. 5 is a diagrammatic view of the electrical circuitry of the warning system of the instant invention.

With attention invited now more specifically to FIG. 5, six branch circuits 41, 42, 43, 44, 45 and 46 are connected at one set of corresponding ends to a supply conductor 48 connected at one end to a source 50 of electrical potential as at 51, the supply conductor 48 having a fuse 52 serially connected therein between the source 50 and the branch circuits 41–46. Each of the branch circuits 41–46 has one of the normally open switches 20 serially connected therein and each branch circuit 20 is electrically connected to a second supply conductor 54 by five conductors 56 each having one of the lights 36 serially connected therein, the ends of each set of conductors 56 remote from the branch circuits 41–46 being electrically connected to bridge conductors 58 which each electrically connect one set of lights 36 to the second supply conductor 54. The second supply conductor 54 is electrically connected to the source 50 as at 60.

Accordingly, and assuming that a person is disposed in a chair 26 at one of the locations G–K, should a person attempt to rob a teller at one of the security zones A–F, that teller will actuate the switch 20 in that security zone. Actuation of the switch 20 in a security zone such as the security zone A will then electrically actuate the signal light 36 at position 1 in each location G–K. Therefore, any person seated in any of the chairs 26 may readily perceive that the signal has been given that a robbery is in process and that person may, in an unobtrusive manner, use the corresponding telephone 28 to notify police or other security forces. In addition, the locations G–K may include other manually actuatable means for summoning security forces in an unobtrusive manner.

By providing the signal lights 36 on the rear sides of the name plate assemblies 30, the signal lights 36 are of course disposed on the sides of the name plate assemblies 30 which face away from the security zones A–F. Furthermore, inasmuch as the otherwise conventional name plate assemblies 30 are used to support the signal lights 36, a person attempting to rob the security zones A–F has no reason to believe that the warning system illustrated in FIG. 5 even exists. The signal lights 36, the electrical circuitry and the switches 20 are all maintained out of sight and the name plate assemblies 30 merely appear as conventional name plate assemblies to a person disposed at either of the zones A–F.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an enclosed building area including a plurality of manned security zones and a plurality of signal receiving locations remote from said security zones, a warning system including signal actuating means in each of said security zones and a plurality of signal generating means in each of said locations with each signal generating means corresponding to a related signal actuating means and including a silent visual warning indicator for viewing by a person manning that location and non-viewable by a person at any of the security zones, electrical circuit means including a source of electrical potential electrically connecting each signal actuating means with the corresponding indicator in each of said locations for actuation thereof, each of said locations including a work surface for the person manning that location and each work surface including information display means thereon projecting upwardly from the corresponding work surface, said display means each including a front side for visually disseminating information generally toward said security zones and an opposite rear side from which the indicators for that location are viewable and which faces away from the security zones.

2. In combination with an enclosed building area including a plurality of manned security zones and a plurality of signal receiving locations remote from said security zones, a warning system including signal actuating means in each of said security zones and a plurality of signal generating means in each of said locations with each signal generating means corresponding to a related signal actuating means and including a silent visual warning indicator for viewing by a person manning that location and non-viewable by a person at any of the security zones, electrical circuit means including a source of electrical potential electrically connecting each signal actuating means with the corresponding indicator in each of said locations for actuation thereof, each of said locations including a work surface for the person manning that location and each work surface includes information display means thereon projecting upwardly from the corresponding work surface, said display means including a front side for visually disseminating information generally toward said security zones and an opposite rear side from which the indicators for that location are viewable and which faces away from said security zones, each of said locations including manually actuatable security force summoning means operatively associated therewith for actuation by the person manning that location upon that person visually noting one of the corresponding indicators being actuated.

3. The warning system of claim 2 wherein said work surfaces comprise desk tops and said display means comprise name indicating members supported from said surfaces.

4. The warning system of claim 3 wherein said visual warning indicators comprise electrically actuated light generating means viewable from the rear sides of said name indicating members.

5. The warning system of claim 3 wherein said signal generating means comprise electrically actuated means serially connected in portions of said circuit means in which the corresponding light generating means are electrically connected.

6. The warning system of claim 2 wherein said building area comprises a banking institution area and at least some of said security zones comprise teller manned zones.

7. The warning system of claim 6 wherein said locations include an information clerk location and a bank official location.

8. In combination with an enclosed building area including a plurality of manned security zones and a plurality of signal receiving locations remote from said security zones, a warning system including signal actuating means in each of said security zones and a plurality of signal generating means in each of said locations with each signal generating means corresponding to a related signal actuating means and including a silent visual warning indicator for viewing by a person manning that location and non-viewable by a person at any of the security zones, electrical circuit means including a source of electrical potential electrically connecting each signal actuating means with the corresponding indicator in each of said locations for actuation thereof, said building area comprising a banking institution area and at least some of said security zones comprising teller manned zones, said locations including an information clerk location and a bank official location, each of said locations including a work surface for the person manning that location and each work surface including information display means thereon projecting upwardly from the corresponding work surface, said display means each including a front side for visually disseminating information generally toward said security zones and an opposite rear side from which the indicators for that location are viewable and which faces away from said security zones, each of said locations including manually actuatable security force summoning means operatively associated therewith for actuation by the person manning that location upon that person visually noting one of the corresponding indicators being actuated.

9. The warning system of claim 8 wherein said work surfaces comprise desk tops and said display means comprise name indicating members supported from said surfaces.

10. The warning system of claim 9 wherein said visual warning indicators comprise electrically actuated light generating means viewable from the rear sides of said name indicating members.

11. The warning system of claim 9 wherein said signal generating means comprise electrically actuated means serially connected in portions of said circuit means in which the corresponding light generating means are electrically connected.

* * * * *